United States Patent [19]

Metzen

[11] Patent Number: 4,888,860

[45] Date of Patent: Dec. 26, 1989

[54] APPARATUS AND METHOD FOR SHRINK TREATING A TEXTILE FABRIC WEB

[75] Inventor: Heinz Metzen, Moenchengladbach, Fed. Rep. of Germany

[73] Assignee: A. Monforts GmbH & Co., Fed. Rep. of Germany

[21] Appl. No.: 254,496

[22] Filed: Oct. 6, 1988

[30] Foreign Application Priority Data

Oct. 10, 1987 [DE] Fed. Rep. of Germany ..... 3734333

[51] Int. Cl.[4] ..... D06C 21/00

[52] U.S. Cl. ..... 26/18.6

[58] Field of Search ..... 26/18.5, 18.6, 19, 20

[56] References Cited

U.S. PATENT DOCUMENTS 2,132,156 11/1936 Gessner ..... 26/18.5
2,276,605 3/1942 Andrews ..... 26/18.5

FOREIGN PATENT DOCUMENTS 2438143 3/1975 Fed. Rep. of Germany ..... 26/18.6
3213716 10/1983 Fed. Rep. of Germany ..... 26/18.6

OTHER PUBLICATIONS

Morrison Textile Machinery Co., The "Cluett" Line of Shrinkage Control Equipment, Oct. 1976.

*Primary Examiner*—Werner H. Schroeder
*Assistant Examiner*—Jodi A. Tokar
*Attorney, Agent, or Firm*—Shefte, Pinckney & Sawyer

[57] ABSTRACT

An apparatus and method for shrink treating both woven and knitted textile fabrics with essentially equal effectiveness provides a fabric-elevating intake device, a shrinking unit, a calendering device and a cuttling device in sequence for shrink treatment of woven fabrics in conventional fashion. Knitted fabrics bypass the fabric wetting device in the intake device and are wetted only lightly by a steaming cylinder provided at the intake side of the shrinking unit. An auxiliary fabric spreading device having driven rolls is also provided at the intake side of the shrinking unit to insure that knitted fabric is opened to a smooth full-width flat form. A small diameter drying cylinder is provided for partially drying knitted fabric without passage through the calendering device and a conveyor transports the knitted fabric in a relaxed condition to a winding mechanism. Woven fabrics are wetted by both the wetting device and the steaming cylinder and, after the shrinking unit, are calendered and cuttled in conventional fashion. Thus, problems of overwetting, overdrying and elongation of knitted fabrics are avoided, while retaining the capability for full conventional shrink processing of woven fabrics.

11 Claims, 1 Drawing Sheet

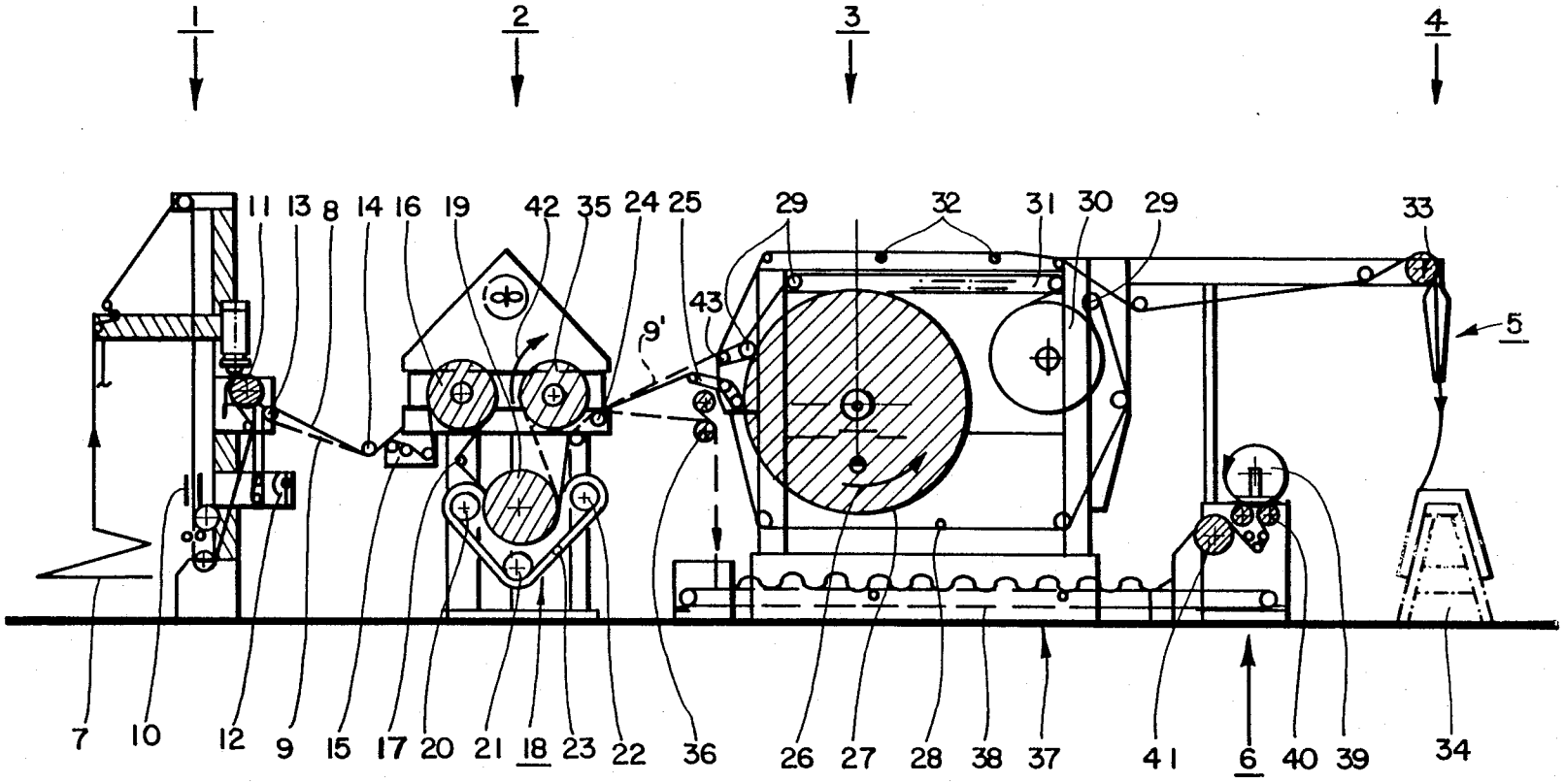
1
2
3
4
5
6
7
8
9
9'
10
11
12
13
14
15
16
17
18
19
20
21
22
23
24
25
26
27
28
29
30
31
32
33
34
35
36
37
38
39
40
41
42
43

APPARATUS AND METHOD FOR SHRINK TREATING A TEXTILE FABRIC WEB

BACKGROUND OF THE INVENTION

The present invention relates generally to apparatus and methods for shrink treating a traveling textile fabric web and, more particularly, to such an apparatus and method adapted for treating both woven and knitted fabrics.

In the finishing of textile fabrics, particularly fabrics which are susceptible to shrinkage when laundered, it is known to subject such fabrics to a shrinkage treatment to improve the dimensional stability of the fabric. In conventional equipment for this purpose, the fabric web to be treated is initially passed through an intake mechanism wherein traction and guide rolls elevate the fabric web and then direct it downwardly through a device for spreading the fabric into flat open width form followed by a spray or similar device for wetting the fabric to a predetermined degree. The flat wetted fabric is then fed into a compressive shrinkage unit wherein the fabric is compressed between a rotating drum and a traveling elastic belt trained in peripheral compressive contact with the drum for mechanically shrinking the fabric. The fabric is passed over another stationary fabric spreading device after leaving the shrinking unit and is then delivered to a calendering mechanism wherein the fabric is dried in flattened sheet form between a large diameter heated calender drum and a traveling endless belt of felt material trained in peripheral contact with the calender drum about a substantial extent of its circumference. Following the calendering mechanism, the fabric is guided over several guide rollers to a cuttling device for pleated folding of the fabric or to a winder for winding the fabric about a storage tube.

The shrink treatment apparatus and process described above produces good results when utilized for most woven fabrics but, for a number of reasons, is generally unsuitable for shrinkage treatment of knitted fabrics. First of all, knitted textile fabrics typically have a greater capability for moisture retention than woven fabrics and, accordingly, in shrink treating knitted fabrics, a markedly lesser degree of fabric wetting is necessary. For example, woven fabrics generally are wetted for shrink treatment to approximately a 10% moisture content by weight of the fabric, whereas knitted fabric should not be wetted to greater than a 5% moisture content by fabric weight for proper shrink treating results. As a result, the spray wetting of fabrics in conventional shrink treating apparatus as described above is unsuitable for processing knitted fabric.

Further, the downward travel of the elevated fabric through the fabric spreading device in conventional shrink treating equipment, while important and necessary for opening woven fabric to a flat full-width sheet form, causes knitted fabric to contract widthwise into drape-like folds. Therefore, knitted fabric cannot be effectively smoothed and held in flat open-width form by the intake mechanism of conventional shrinkage equipment, as is necessary for effective shrink treatment.

A further difficulty in shrink treating knitted fabric utilizing conventional shrinkage equipment of the above-described type is that, even if knitted fabric is wetted only to the reduced moisture content within the acceptable range, the fabric still should be dried considerably less by the calendering mechanism following shrinking than when processing woven fabric. In this regard, it is desirable that knitted fabrics should not be fully dried within the shrinking system but instead should be allowed to dry gradually to achieve good shrinking results. Thus, in contrast to the processing of woven fabrics, knitted fabrics should not be overdried but rather should retain some percentage of moisture when delivered from the shrinking mechanism. Accordingly, in using conventional equipment for shrink processing of knitted fabric, the calendering mechanism must be operated to produce a significantly reduced amount of drying energy in comparison with the processing of woven fabrics in order to reduce the extent of the drying of knitted fabrics.

As mentioned above, in conventional shrink treating equipment, the fabric is guided over a series of guide rollers to travel from the calendering mechanism to a cuttler or a winder. Typically, the guide rollers are positioned above the calendering mechanism so that the fabric follows an upward path from the calendering drum. However, knitted fabrics tend to undergo a degree of stretching when transported along an upward path following shrinking, negating a considerable amount of the fabric shrinkage achieved.

Thus, since conventional shrinking equipment designed for woven fabric is generally unsuitable for shrink treatment of knitted fabrics, specialized shrinking equipment has been developed especially for the shrink processing of knitted fabric, but as will be understood considerably greater expense is incurred in acquiring, operating and maintaining separate shrinking systems for woven and knitted fabrics. To avoid the additional expenses involved, it is possible to make structural alterations in conventional shrinkage treating equipment designed for woven fabrics in order to convert the equipment for use with knitted fabrics. However, such modifications are economically justifiable only if the equipment is to be operated as altered for a relatively long period of time, e.g., one month or more. Numerous textile factories, such as finishing jobbers, must instead shrink treat woven and knitted fabrics in frequent alternation and accordingly, such factories are forced therefore to acquire separate shrinking equipment for woven and knitted fabrics.

SUMMARY OF THE INVENTION

It is accordingly an object of the present invention to provide a textile fabric shrink treatment apparatus and method which can be used without significant modifications for processing either woven or knitted fabrics. Specific objects of the present invention are to provide suitable means for smoothly spreading both woven and knitted fabrics into flat full-width form preliminary to shrinking, to provide for selective wetting of such fabrics within differing ranges of acceptable moisture contents, and to allow adjustment of the degree of drying to which such fabrics are subjected after shrinking. For example, an object is to provide means by which woven fabric may be cuttled into folded pleats after calendering, while permitting knitted fabrics to be wound without calendering treatment. Another object is to provide for operation of the entire shrinking system in a manner which allows doffing of wound knitted fabric or of folded woven fabric without interrupting the shrink treatment operation.

Briefly summarized, the apparatus and method of the present invention provides a fabric elevating device for fabric intake in a downward direction, a main fabric spreading device, a fabric wetting device, an auxiliary fabric spreading device, a fabric steaming device capable of lightly moistening a traveling fabric web, and a fabric shrinking unit arranged in sequence with one another, a relatively small diameter fabric drying cylinder and a relatively large diameter fabric calendering device arranged for alternate fabric drying operation in sequence following the fabric shrinking unit, a device for transporting fabric in relaxed condition and a fabric winding mechanism arranged in sequence following the fabric transporting device, and a fabric cuttling mechanism arranged in sequence following the calendering device. A guide arrangement is provided for selectively guiding a woven fabric web to travel for shrink treatment sequentially to the fabric elevating device, the main spreading device, the wetting device, the steaming device, the shrinking unit, the calendering device and the cuttling mechanism. The wetting device and the steaming device are cooperatively adjustable for selectively wetting the woven fabric web to a desirable moisture content. Alternatively, the guiding arrangement is adapted for selectively guiding a knitted fabric web to travel for shrink treatment sequentially to the fabric elevating device, the main spreading device, the auxiliary spreading device, the steaming cylinder, the shrinking unit, the drying cylinder, the fabric transporting device, and the winding mechanism.

The auxiliary fabric spreading device preferably includes driven spreading rollers for engaging the traveling fabric web between the fabric intake device and the steaming device to insure that knitted fabrics are presented to the steaming cylinder in smooth, flattened, open-width form even though the knitted fabric is taken into the shrinking system along a downward intake path from the fabric elevating device. The driven spreading rollers are of course unnecessary for opening woven fabrics to a smooth, flat form, but the rollers do not exert any undesirable influence on a woven fabric already spread open by the main fabric spreading device. Accordingly, both woven and knitted fabrics may follow the same path through the fabric elevating device, the main fabric spreading device and the auxiliary fabric spreading device.

The steaming device preferably is a driven cylinder adapted to impart steam to a fabric passing in peripheral contact with the cylinder and, accordingly, the steaming device is utilized instead of the wetting device for moistening knitted fabrics to a limited degree. In this regard, the steaming cylinder is designed to provide a uniform moistening of knitted fabrics over the entire surface of the cylinder while limiting moisture content imparted to the fabric to no more than approximately 5% of the fabric web weight. On the other hand, woven fabrics are guided to both the fabric wetting device and the steaming cylinder and, accordingly, the wetting device and the steaming cylinder are adjusted to cooperatively impart a desired more elevated moisture content to woven fabrics, as aforementioned, thereby to achieve the most advantageous wetting of woven fabrics.

Following the shrinking unit, woven fabric is delivered to the calendering device for drying and is then guided to the cuttling device for folding in normal pleated fashion. Preferably, the fabric is guided over a stationary fabric spreading device in advance of delivery to the calendering device. The calendering device is preferably of the conventional type having a large diameter heated calendering drum with an endless belt of felt material traveling along part of the drum's periphery. On the other hand, knitted fabric which, as mentioned, has a considerably lower moisture content, is guided from the shrinking unit to the fabric drying cylinder, which is of a considerably smaller diameter than the drum of the calendering device so as to provide only a light partial drying of the knitted fabric. The knitted fabric is not delivered to the stationary fabric spreader or to the calendering device to avoid the considerable losses of shrinkage in the knitted fabric as would be expected. Instead, following the small diameter drying cylinder, knitted fabric is guided directly onto the transporting device, preferably an endless driven conveyor belt, for movement in a relaxed condition to the winding mechanism which, for example, may be of the so-called ascending batch type wherein the wound fabric roll is supported on a pair of spaced parallel driven rollers.

The shrinking unit is preferably of the conventional type wherein the traveling fabric web is compressed against a rotating drum by an endless elastic belt, as above-described. As will be understood, such a shrinking unit imparts a shiny surface effect to the side of the treated fabric web facing the rotating drum due to the extent of surface contact of such fabric surface with the drum. This effect is desirable in the case of woven fabrics and, accordingly, the guide arrangement directs the same shiny side of woven fabrics in facing surface contact with the calender drum during drying. However, in the case of knitted fabrics, it is frequently desirable that both fabric surfaces have a shiny appearance. Accordingly, the small diameter drying cylinder of the present invention is arranged with respect to the shrinking unit for surface contact with the face of the knitted fabric which is opposite the face in surface contact with the shrinking drum. Specifically, the drying cylinder is arranged above the shrinking drum for passage of the fabric beneath the shrinking drum and then over the drying cylinder, which provides the additional advantage that the knitted fabric may be directed downwardly onto the fabric conveyor to further avoid any undesirable stretching of the shrunk fabric.

With a few types of knitted fabrics, it is possible to subject the fabric to a calendering operation after shrinkage in similar manner to woven fabrics, but generally the stationary fabric spreading device at the intake to the calender device should be avoided. As will of course be understood, the calender device should be operated with lesser heat energy in conformity to the lesser extent of drying required by the knitted fabric. It is still disadvantageous, however, to transport knitted fabrics upwardly after calendering to travel to either the cuttling device or the winder. With woven fabrics such an upward exit path does not generally adversely affect the shrinkage of the fabric due to the dimensional stability of the dried woven fabric. However, knitted fabrics, even after calendering, generally experience shrinkage loss due to elongation when directed along an upward path. To avoid such problems in cases in which certain types of knitted fabrics are to be calendered after shrinkage, the calendering device is adapted for driving the calender drum and the endless felt belt opposite their normal operational direction for calendering of a knitted fabric. In this manner, a knitted fabric may be discharged immediately downwardly onto the fabric conveyor from the calendering device to avoid any upward fabric travel. Additionally, the reversal of the calender drum results in opposite surfaces of the knitted fabric being in facing contact with the shrinking cylinder and with the calender drum so that a shiny surface effect is imparted to both fabric faces, as is desirable as aforementioned.

BRIEF DESCRIPTION OF THE DRAWINGS

The drawing is a view, partially in lengthwise vertical cross-section and partially in side elevation, of a shrink treatment range for a traveling textile fabric web, in accordance with the preferred embodiment of the present invention.

DESCRIPTION OF THE PREFERRED EMBODIMENT

Referring now to the accompanying drawing, there is shown an overall processing range adapted, in accordance with the present invention, for shrink treating traveling textile fabric webs of both woven and knitted fabric constructions. Basically, the shrink treatment range includes a fabric intake mechanism, generally indicated at 1, a fabric shrinking unit, generally indicated at 2, a calendering device, generally indicated at 3, and a fabric discharge section, broadly indicated at 4, which may include, for example, a fabric cuttling device, generally shown at 5, and a fabric winding mechanism, generally shown at 6. The path of travel through the treating range followed by a textile fabric web 7 to be shrink treated is shown, for sake of clarity, by a solid line 8 representing the treatment path of a woven fabric and by a broken line 9 representing the treatment path of a knitted fabric.

Within the fabric intake mechanism 1, the fabric web 7, whether a woven or knitted fabric, is initially elevated along an essentially upward path and then travels vertically downwardly through a fabric spreading device 10 and is then redirected upwardly to be trained about a driven traction roller 11. In the case of a woven fabric 8, the fabric web is guided downwardly from the traction roller 1 1 through a fabric wetting device 12, which may be of any appropriate conventional construction, e.g., a water spray unit, and is then trained over a guide roll 13, under a guide roll 14 and over a set of driven fabric spreading rolls of an auxiliary fabric spreading device 15 mounted at the intake side of the shrinking unit 2. Following the spreading device 15 the woven fabric 8 travels in peripheral contact about a steam emitting cylinder 18, which imparts a small degree of additional moisture to the fabric 8 in the form of steam and, then, the fabric 8 is directed through a compressive shrinkage device of the aforementioned elastic belt type, generally indicated at 18. The shrinkage device 18 basically includes a rotatable, smooth-surfaced shrinking drum 19 having an endless elastic belt 23 trained about guide and tension rollers 20,21,22 to travel in compressive peripheral surface contact with the downwardly-facing circumferential extent of the shrinking drum 19. The wetted woven fabric 8 is guided to travel between the elastic belt 23 and the shrinking drum 19 whereby, in conventional fashion, the woven fabric 8 is subjected to a mechanical shrinking action resulting from the compressive action of the tensioned elastic belt 23.

The woven fabric 8 is discharged from the shrinking device 18 over a guide roller 24 and a stationary fabric spreading device 25 at the intake side of the calendering device 3. Basically, the calendering device 3 is of an essentially conventional construction including a relatively large diameter cylindrical calender drum 27, which rotates during normal operation in a counterclockwise direction (as viewed in the drawing) indicated by directional arrow 26. An endless belt 28 of felt material is guided by a series of guide rollers 29 to travel in peripheral surface contact over a predominant portion of the circumferential extent of the calender drum 27, excepting only a small arcuate extent at the fabric spreading device 25 for fabric intake. In addition, the belt 28 is also guided in peripheral contact with a heated drying cylinder 30 adapted to remove absorbed moisture from the belt 28 and also about a tensioning unit 31 which maintains a predetermined level of tension in the belt 28. The woven fabric 8 is guided from the fabric spreading device 25 between the calender drum 27 and the belt 28 to travel in surface contact about the periphery of the rotating calender drum 27. The woven fabric 8 is discharged from between the drum 27 and the belt 28 to travel upwardly therefrom over a series of guide rollers 32 to a driven traction roller 33 of the cuttler 5 which is operative in known manner to direct the fabric downwardly in a back-and-forth fashion to fold the fabric in pleats over a rack 34.

For the reasons already fully discussed above, this shrink treating system for the woven fabric 8 is unsuitable for treating the vast majority of knitted fabrics 9. In the case of a knitted fabric 9, the fabric web is transported through the fabric intake device 1 along the same path as a woven fabric 8 through the fabric spreading device 10 and about the traction roller 11 but, because a knitted fabric 9 would be wetted to too high a moisture content if past through the wetting device 12, the knitted fabric 9 is guided from the traction roller 11 immediately under the guide roller 13, bypassing the wetting device 12. The knitted fabric 9 continues its travel under the guide roller 14, over the driven rolls of the auxiliary fabric spreading device 15, which is effective to insure that the knitted fabric is fully opened widthwise in a smooth flat form which normally will not have been accomplished in the case of a knitted fabric 9 by the main fabric spreading device 10 of the intake device 1. The knitted fabric 9, which at this point has not been wetted, is guided next about the periphery of the steaming cylinder 16 which applies a sufficient amount of steam to the knitted fabric 9 to effectively wet the fabric lightly to only the low moisture content needed for shrink treating knitted fabrics. e.g., normally not greater than 5% by fabric weight.

As will thus be understood, the auxiliary fabric spreading device 15 and the steaming cylinder 16 are highly important for effective shrink treatment of knitted fabrics. While the auxiliary spreading device 15 and the steaming cylinder 16 are unnecessary for the shrink treatment of a woven fabric 8, these devices do not have any negative effect in the processing of a woven fabric 8. The steaming cylinder 16 actually supplements the primary wetting of woven fabrics performed by the wetting device 12 to insure that a total desired moisture content is achieved. After being lightly wetted by the steaming cylinder 16, the knitted fabric 9 is passed through the shrinking device 18 for compressive mechanical shrinkage in the same above-described manner as with woven fabrics.

Upon discharge from the shrinking device 18, some types of knitted fabrics may be passed through the calendering device 3 in the same manner as with woven fabrics, but possibly omitting passage of the knitted fabric over the stationary fabric spreader 25. In such cases, the calendering device 3 must be operated to generate only a relatively low level of heating of the knitted fabric 9 so that the fabric is not overdried when discharged from the calendering device 3. The knitted fabric would then be directed along the same upward discharge path over the guide rollers 32 as with woven fabrics, but would preferably be delivered downwardly to the winder 6 rather than the cuttler 5. As aforementioned, most knitted fabrics, however, when directed along such an upward discharge path, would experience a degree of elongation negating a significant amount of the shrinkage obtained by the preceding treatment steps and, accordingly, the majority of knitted fabrics would not be calendered in this manner.

Instead, in accordance with the present invention, most knitted fabrics are directed, upon discharge from the shrinking device 18, to travel peripherally about a drying cylinder 35 which is driven rotationally in the direction of the arrow 42 and which is heated to perform a partial drying of the knitted fabric but, because the drying cylinder 35 is of a substantially smaller diameter than the calender drum 26, the knitted fabric is assured of not being overheated and overdried. Advantageously, the knitted fabric 9 is directed to pass over, rather than under, the drying cylinder 35. In this manner, the opposite face of the knitted fabric 9 is advantageously in surface contact with the cylinder 35 from the fabric face which contacts the shrinking cylinder 19 and, additionally, the knitted fabric 9 may be discharged in a downward, rather than upward, direction from the drying cylinder 35. Accordingly, the knitted fabric 9 travels from the drying cylinder 35 over a driven roll 36 and directly downwardly onto a fabric transporting device, generally indicated at 37. The fabric transport device 37 preferably is an endless horizontally-extending conveyor belt 38 by which the shrunken knitted fabric 9 is transported in an untensioned relaxed condition to the winder 6. Preferably, the winder 6 is of the conventional so-called ascending batch type wherein fabric is wound onto a supporting tube or other core 39 which is rotatably supported between a pair of driven parallel traction and winding control rollers 40,41.

As a further alternative, a knitted fabric 9, after discharge from the shrinking device 18, may be subjected to a calendering operation by the calendering device 3 with its calender drum rotated opposite its normal rotational direction 26 and, of course, with its endless felt belt 28 moving opposite to its normal direction of travel. In such case, the knitted fabric 9 bypasses the drying cylinder 35 and is guided directly over the roller 24 along a path indicated at 9' toward the location of normal fabric discharge from the calender drum 27 whereat the knitted fabric is guided over a guide roller 43 and directed between the calender drum 27 and the endless belt 28. Hereagain, the calendering device 3 is operated to produce a low level of heating of the knitted fabric 9 to avoid overdrying of the fabric. By operation of the calender drum 27 and the belt 28 oppositely of their normal directions of operational movement, the knitted fabric may be discharged from the calender drum 3 in a downward direction over the driven traction roller 36 and directly onto the fabric transport conveyor 38, avoiding the risk of shrinkage loss due to fabric elongation. The knitted fabric 9 in this case would, of course, be wound at the winder 6 in the same manner as before.

Preferably, the processing range, whether treating a woven or a knitted fabric, is operated at a fabric processing rate which imparts a traveling speed to the fabric under treatment suitable to enable doffing of the winder 6 or the cuttler rack 34 without interrupting the shrink treatment operation of the range so that fabric shrinking can be continuous.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for shrink treating a traveling textile fabric web of either woven or knitted construction, comprising a fabric elevating device for downward fabric intake, a main fabric spreading device, a fabric wetting device, an auxiliary fabric spreading device, a fabric steaming device for lightly moistening a traveling fabric web, and a fabric shrinking unit arranged in sequence with one another, a relatively small diameter fabric drying cylinder and a relatively large diameter fabric calendering device arranged for alternate fabric drying operation sequentially following said fabric shrinking unit, a device for transporting fabric in relaxed condition sequentially following said drying cylinder, a fabric winding mechanism arranged sequentially following said fabric transporting device, a fabric cuttling mechanism arranged sequentially following said calendering device, and means for selectively guiding a woven fabric web to travel for shrink treatment sequentially to said fabric elevating device, said main spreading device, said wetting device, said steaming device, said shrinking unit, said calendering device and said cuttling mechanism and for selectively guiding a knitted fabric web to travel for shrink treatment sequentially to said fabric elevating device, said main spreading device, said auxiliary spreading device, said steaming device, said shrinking unit, said drying cylinder, said fabric transporting device, and said winding mechanism, said wetting device and said steaming device being cooperatively adjustable for selectively wetting a woven fabric web to a desired moisture content.

2. Apparatus for shrink treating a traveling textile fabric web according to claim 1 and characterized further in that said steaming device comprises a driven fabric steaming cylinder arranged for peripherally contacting a traveling fabric web.

3. Apparatus for shrink treating a traveling textile fabric web according to claim 1 and characterized further in that said auxiliary spreading device comprises a driven fabric-spreading roll.

4. Apparatus for shrink treating a traveling textile fabric web according to claim 1 and characterized further in that said steaming device is adapted for moistening a fabric web to a maximum moisture content of approximately 5% of the web weight.

5. Apparatus for shrink treating a traveling textile fabric web according to claim 1 and characterized further in that said guiding means is adapted for optional guiding of a knitted fabric to bypass said drying cylinder and to travel to said calendering device intermediate said shrinking unit and said fabric transporting device, said calendering device including a calender drum driven in the direction of web travel in the case of both knitted and woven fabric webs.

6. Apparatus for shrink treating a traveling textile fabric web according to claim 1 and characterized further in that said fabric transporting device comprises an endless driven conveyor belt.

7. Apparatus for shrink treating a traveling textile fabric web according to claim 1 and characterized further in that said guiding means is adapted for guiding a knitted fabric web to bypass said wetting device.

8. Apparatus for shrink treating a traveling textile fabric web according to claim 1 and characterized further in that said apparatus is arranged to impart a traveling speed to fabric web being treated which enables doffing said winding mechanism and said cuttling mechanism without interrupting shrink treatment operation of said apparatus.

9. A method for shrink treating a traveling textile fabric web of either woven or knitted construction, comprising the steps of arranging a fabric elevating device for downward fabric intake, a main fabric spreading device. a fabric wetting device, an auxiliary fabric spreading device, a fabric steaming device for lightly moistening a traveling fabric web, and a fabric shrinking unit in sequence with one another, arranging a relatively small diameter fabric drying cylinder and a relatively large diameter fabric calendering device for alternate fabric drying operation sequentially following said fabric shrinking unit, arranging a device for transporting fabric in relaxed condition sequentially following said drying cylinder, arranging a fabric winding mechanism sequentially following said fabric transporting device, arranging a fabric cuttling mechanism sequentially following said calendering device, selectively treating a woven fabric web by adjusting said wetting device and said steaming device cooperatively for selectively wetting the woven fabric web in a desired amount and guiding the woven fabric web to travel for shrink treatment sequentially to said elevating device, said main spreading device, said wetting device, said steaming device, said shrinking unit, said calendering device and said cuttling mechanism, and selectively treating a knitted fabric web by guiding the knitted fabric web to travel for shrink treatment sequentially to said fabric elevating device, said main spreading device, said auxiliary spreading device, said steaming device, said shrinking unit, said drying cylinder, said fabric transporting device, and said winding mechanism.

10. A method for shrink treating a traveling textile fabric web according to claim 9 and characterized further in that said guiding a knitted fabric web comprises bypassing said wetting device.

11. A method for shrink treating a traveling textile fabric web according to claim 9 and characterized further in that each said guiding of a knitted fabric web and of a woven fabric web comprises imparting a traveling speed to the fabric web which enables doffing of said winding mechanism and said cuttling mechanism without interrupting shrink treatment operation of said apparatus.

* * * * *